US007028497B2

(12) United States Patent
Upton et al.

(10) Patent No.: US 7,028,497 B2
(45) Date of Patent: Apr. 18, 2006

(54) REFRIGERATED MERCHANDISER WITH FOUL-RESISTANT CONDENSER

(75) Inventors: Ronald D. Upton, Spartanburg, SC (US); Harry A. Brancheau, Inman, SC (US); Robert J. Reese, Spartanburg, SC (US); Eugene Duane Daddis, Jr., Manlius, NY (US); Timothy J. Roberts, Collierville, TN (US)

(73) Assignee: Carrier Commercial Refrigeration, Inc., Charlotte, NC (US)

( * ) Notice: Subject to any disclaimer, the term of this patent is extended or adjusted under 35 U.S.C. 154(b) by 0 days.

(21) Appl. No.: 10/960,387

(22) Filed: Oct. 7, 2004

(65) Prior Publication Data

US 2005/0150241 A1 Jul. 14, 2005

Related U.S. Application Data

(62) Division of application No. PCT/US03/12468, filed on Apr. 23, 2003.

(60) Provisional application No. 60/376,486, filed on Apr. 30, 2002.

(51) Int. Cl.
*F25B 39/04* (2006.01)

(52) U.S. Cl. ..... 62/246; 62/507; 165/177

(58) Field of Classification Search ..... 62/246, 62/507–508; 165/156, 163, 172, 177
See application file for complete search history.

(56) References Cited

U.S. PATENT DOCUMENTS

| | | | | |
|---|---|---|---|---|
| 1,798,795 | A | | 3/1931 | Hilger |
| 1,859,840 | A | | 5/1932 | Phelps |
| 1,883,919 | A | | 10/1932 | Hull |
| 2,038,434 | A | | 4/1936 | Lipman |
| 2,316,284 | A | | 4/1943 | Ploeger |
| 3,148,516 | A | * | 9/1964 | Walter ..... 62/305 |
| 3,307,373 | A | | 3/1967 | Booth |
| 3,388,562 | A | | 6/1968 | Harle |
| 4,196,157 | A | * | 4/1980 | Schinner ..... 261/155 |
| 4,316,435 | A | * | 2/1982 | Nagamatsu et al. ... 122/235.17 |
| 4,755,331 | A | * | 7/1988 | Merrill et al. ..... 261/153 |
| 4,977,754 | A | | 12/1990 | Upton et al. |
| 5,472,047 | A | * | 12/1995 | Welkey ..... 165/172 |
| 5,791,404 | A | * | 8/1998 | Bailey et al. ..... 165/159 |

FOREIGN PATENT DOCUMENTS

| | | |
|---|---|---|
| DE | 648440 | 7/1937 |
| DE | 1000407 | 1/1957 |
| JP | 06140335 | 6/1994 |

* cited by examiner

*Primary Examiner*—William E. Tapolcai
(74) *Attorney, Agent, or Firm*—Wall Marjama & Bilinski LLP

(57) ABSTRACT

A refrigerated cold beverage merchandiser (10) includes an enclosure defining an insulated, refrigerated display cabinet (25) and a compartment (30) heat insulated therefrom wherein a compressor (40) a condenser (50) and a condenser fan (60) are disposed. The condenser (50) is formed by a plurality of in-line tube banks (52). Each tube bank (52) is a serpentine tube formed a plurality of unfinned, straight tube segments (54) extending in parallel rows (55) between a pair of spaced, opposed end plates (58) and elbow turns (56) connecting neighboring straight tube segments (56) in a conventional manner. Each successive tube bank (52) is arranged with the other tube banks so that respective parallel tube rows (55) are disposed in-line from the front to the rear of the condenser (50) or with each successive tube bank being offset in a slightly staggered arrangement.

3 Claims, 4 Drawing Sheets

REFRIGERATED MERCHANDISER WITH FOUL-RESISTANT CONDENSER

This application is a divisional of PCT/US03/12468, filed Apr. 23, 2003, which also claims the benefit of Provisional Aplication No. 60/376,468, filed Apr. 30, 2002 which is incorporated herein by reference.

TECHNICAL FIELD

The present invention relates generally to refrigerated cold beverage merchandisers and, more particularly, to a refrigerated cold beverage merchandiser having a condenser that resists airside fouling.

BACKGROUND OF THE INVENTION

Cold beverages, such as soft drinks, beer, wine coolers, etc. are commonly displayed in convenience stores, supermarkets and other retail establishments in refrigerated merchandisers for self-service purchase by customers. Conventional merchandisers of this type conventionally comprise a refrigerated, insulated enclosure defining a refrigerated product display cabinet and having one or more glass doors. The beverage product, typically in cans or bottles, single or in six-packs, is stored on shelves within the refrigerated display cabinet. To purchase a beverage, the customer opens one of the doors and reaches into the refrigerated cabinet to retrieve the desired product from the shelf.

Beverage merchandisers of this type necessarily include a refrigeration system for providing the cooled environment within the refrigerated display cabinet. Such refrigeration systems include an evaporator housed within the insulated enclosure defining the refrigerated display cabinet and a condenser and compressor housed in a compartment separate from and exteriorly of the insulated enclosure. Cold liquid refrigerant is circulated through the evaporator to cool the air within the refrigerated display cabinet. As a result of heat transfer between the air and the refrigerant passing in heat exchange relationship in the evaporator, the liquid refrigerant evaporates and leaves the evaporator as a vapor. The vapor phase refrigerant is then compressed in the compressor to a high pressure, as well as being heated to a higher temperature as a result of the compression process. The hot, high pressure vapor is then circulated through the condenser wherein in passes in heat exchange relationship with ambient air drawn or blown across through the condenser by a fan disposed in operative association with the condenser. As a result, the refrigerant is cooled and condensed back to the liquid phase and then passed through an expansion device which reduces both the pressure and the temperature of the liquid refrigerant before it is circulated back to the evaporator.

In conventional practice, the condenser comprises a plurality of tubes with fins extending across the flow path of the ambient air stream being drawn or blown through the condenser. A fan, disposed in operative association with the condenser, passes ambient air from the local environment through the condenser. U.S. Pat. No. 3,462,966 discloses a refrigerated glass door merchandiser having a condenser with staggered rows of finned tubes and an associated fan disposed upstream of the condenser that blows air across the condenser tubes. U.S. Pat. No. 4,977,754 discloses a refrigerated glass door merchandiser having a condenser with in-line finned tube rows and an associated fan disposed downstream of the condenser that draws air across the condenser tubes. A problem associated with conventional condensers is that over time dust, grease and other matter carried in the ambient air passing through the condenser collects on the condenser tubes. This air side fouling is problematic in that as the dust and other matter build up on the outside of the condenser tubes, heat transfer between refrigerant flowing through the tubes and the ambient air passing over the tubes decreases thereby degrading overall condenser performance.

SUMMARY OF THE INVENTION

It is an object of this invention to provide a refrigerated cold beverage merchandiser having a condenser that resists air side fouling.

A refrigerated cold beverage merchandiser is provided having an insulated enclosure defining a product display cabinet and a compartment separate from the insulated enclosure wherein a compressor, condenser and condenser fan are housed. The insulated enclosure has an access opening, which preferably has one or more doors that may be opened by the customer to access product shelved within the refrigerated display cabinet. The condenser comprises a plurality of tube rows disposed in a particular arrangement extending between opposite side end plates with the tubes being bare, non-finned tubes. The non-finned condenser tubes are arranged in alternately disposed first and second tube rows, with a longitudinal spacing between first and second rows of $S_l$, there being at least one first row and at least one second row. Each row is defined by a plurality of parallelly disposed tubes spaced apart in row at a transverse spacing, $S_t$. The condenser fan is disposed adjacent the condenser and is advantageously encompassed by a shroud which extends to and mates with the condenser end plates whereby the air flow is channeled through the condenser.

In one embodiment of the present invention, the condenser comprises a plurality of non-finned tube rows disposed in an in-line arrangement extending between opposite side end plates, the tube arrangement having a ratio of $S_l/S_t$ of at least 0.7. In another embodiment of the present invention, the non-finned condenser tubes are arranged in at least one first row and at least one second row, with each tube of the second row disposed relative to a respective tube of the first row at a transverse offset, $S_s$, measured tube centerline to tube centerline of not greater than 0.25 $S_t$, the tubes disposed in an arrangement having a ratio of $S_l/S_t$ of at least 0.7.

DESCRIPTION OF THE DRAWINGS

For a further understanding of the present invention, reference should be made to the following detailed description of a preferred embodiment of the invention taken in conjunction with the accompanying drawings wherein.

DESCRIPTION OF THE PREFERRED EMBODIMENT

Figure 1:
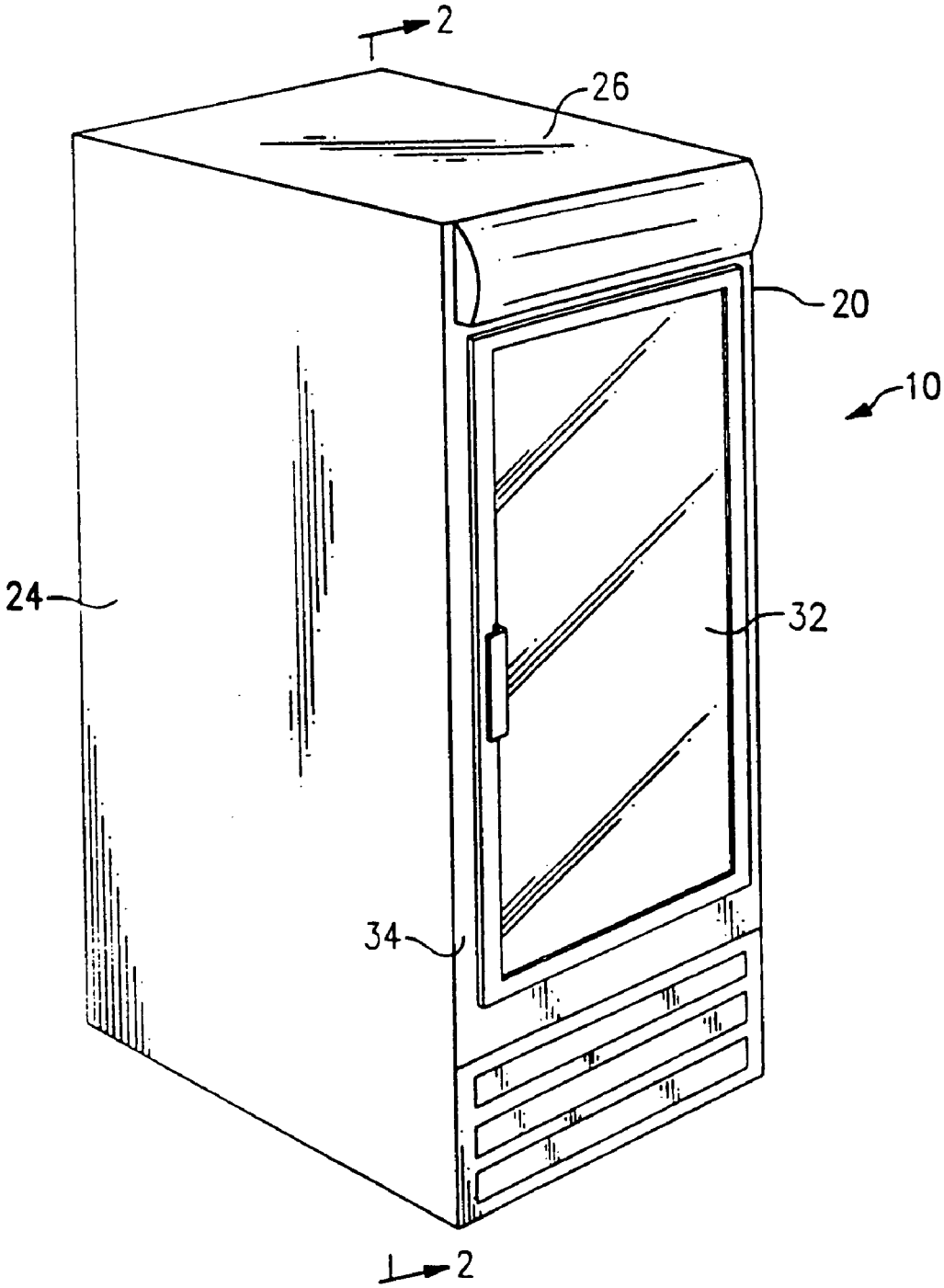
FIG. 1 is a perspective view from the front and the side of a refrigerated beverage merchandiser.
Figure 2:
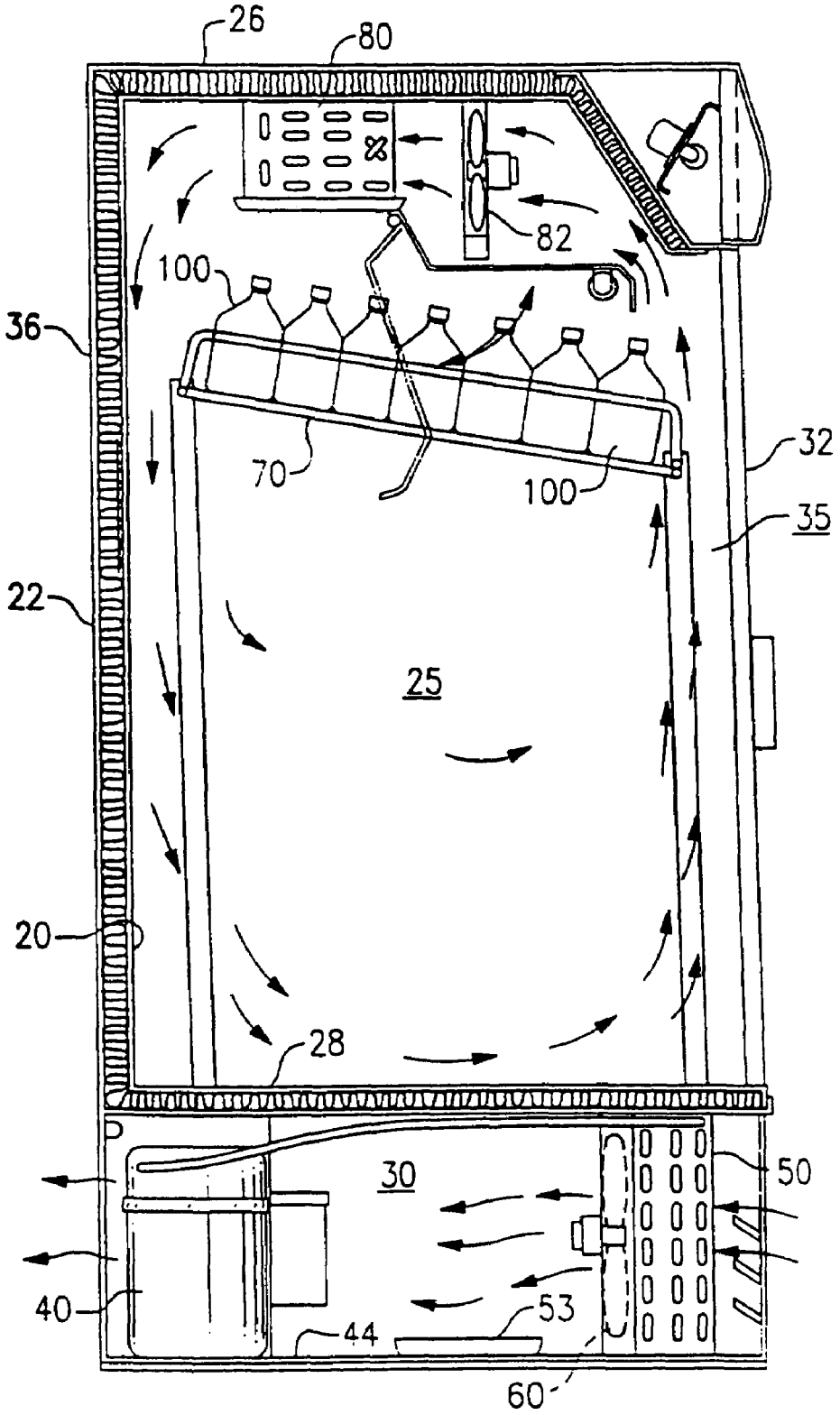
FIG. 2 is a sectional, side elevation view of the refrigerated beverage merchandiser taken along line 2—2 of FIG. 1 showing the condenser and fan assembly.

Referring now to FIGS. 1 and 2, there is depicted therein a refrigerated cold beverage merchandiser generally designated by the numeral 10. The beverage merchandiser 10 includes an enclosure 20 defining a refrigerated display cabinet 25 and a separate utility compartment 30 disposed externally of and heat insulated from the refrigerated display cabinet 25. The utility compartment may be disposed beneath the refrigerated display cabinet 25 as depicted or the utility compartment may be disposed above the display cabinet 25. A compressor 40, a condenser 50, a condensate pan 53 and an associated condenser fan and motor 60 are housed within the compartment 30. A mounting plate 44 may be disposed beneath the compressor 40, the condenser 50, and the condenser fan 60. Advantageously, the mounting plate 44 may be slidably mounted within the compartment 30 for selective disposition into and out of the compartment 30 in order to facilitate servicing of the refrigeration equipment mounted thereon.

The refrigerated display cabinet 25 is defined by an insulated rear wall 22 of the enclosure 20, a pair of insulated side walls 24 of the enclosure 20, an insulated top wall 26 of the enclosure 20, an insulated bottom wall 28 of the enclosure 20 and an insulated front wall 34 of the enclosure 20. Heat insulation 36 (shown by the looping line) is provided in the walls defining the refrigerated display cabinet 25. Beverage product 100, such as for example individual cans or bottles or six packs thereof, are displayed on shelves 70 mounted in a conventional manner within the refrigerated display cabinet 25, such as for example in accord with the next-to-purchase manner shown in U.S. Pat. No. 4,977,754, the entire disclosure of which is hereby incorporated by reference. The insulated enclosure 20 has an access opening 35 in the front wall 34 that opens to the refrigerated display cabinet 25. If desired, a door 32, as shown in the illustrated embodiment, or more than one door, may be provided to cover the access opening 35. It is to be understood however that the present invention is also applicable to beverage merchandisers having an open access without a door. To access the beverage product for purchase, a customer need only open the door 32 and reach into the refrigerated display cabinet 25 to select the desired beverage.

An evaporator 80 is provided within the refrigerated display cabinet 25, for example near the top wall 26. An evaporator fan and motor 82, as illustrated in FIG. 2, may be provided to circulate air within the refrigerated display cabinet 25 through the evaporator 80. However, the evaporator fan is not necessary as natural convection may be relied upon for air circulation through the evaporator. As the circulating air passes through the evaporator 80, it passes in a conventional manner in heat exchange relationship with refrigerant circulating through the tubes of the evaporator and is cooled as a result. The cooled air leaving the evaporator 80 is directed downwardly in a conventional manner into the cabinet interior to pass over the product 100 disposed on the shelves 70 before being drawn back upwardly to again pass through the evaporator.

Refrigerant is circulated in a conventional manner between the evaporator 80 and the condenser 50 by means of the compressor 40 through refrigeration fines forming a refrigeration circuit (not shown) interconnecting the compressor 40, the condenser 50 and the evaporator 80 in refrigerant flow communication. As noted before, cold liquid refrigerant is circulated through the evaporator 80 to cool the air within the refrigerated display cabinet 25. As a result of heat transfer between the air and the refrigerant passing in heat exchange relationship in the evaporator 80, the liquid refrigerant evaporates and leaves the evaporator as a vapor. The vapor phase refrigerant is then compressed in the compressor 40 to a high pressure, as well as being heated to a higher temperature as a result of the compression process. The hot, high pressure vapor is then circulated through the condenser 50 wherein in passes in heat exchange relationship with ambient air drawn or blown across through the condenser 50 by the condenser fan 60.

Figure 3:
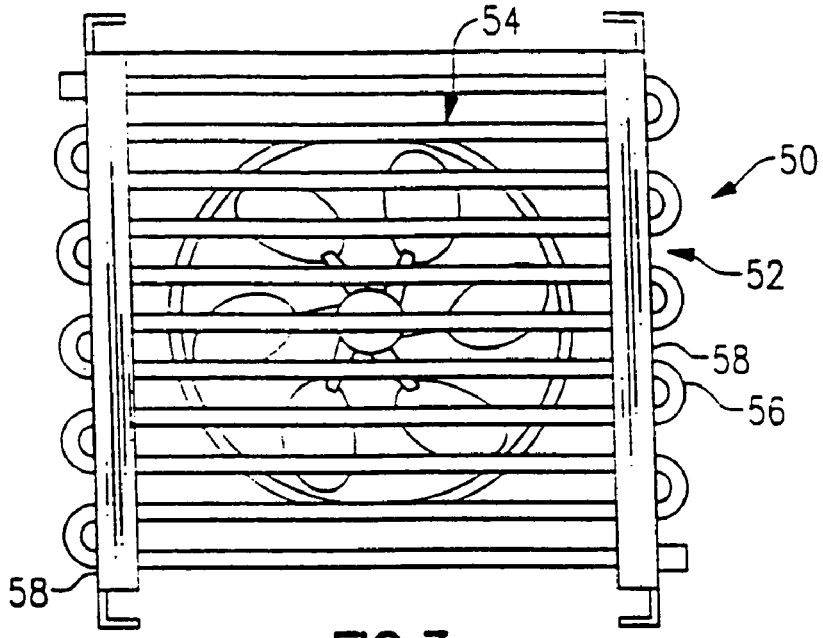
FIG. 3 is a frontal elevation view showing an in-line embodiment of the condenser of the present invention.
Figure 4:
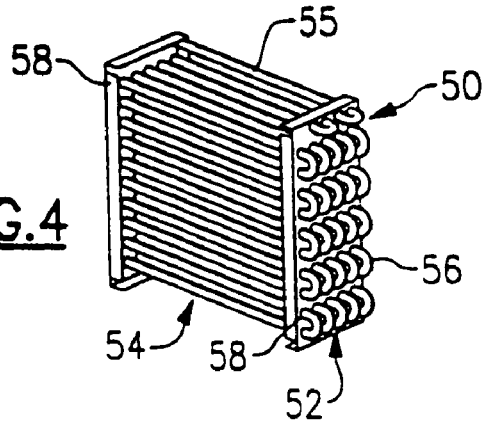
FIG. 4 is a perspective view of the condenser of FIG. 3.
Figure 7:
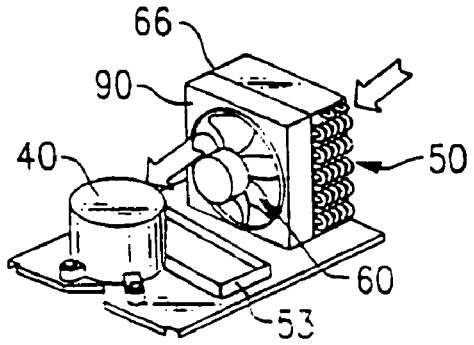
FIG. 7 is a perspective view of the condenser-fan assembly of the refrigerated beverage merchandiser of FIG. 1.
Figure 5:
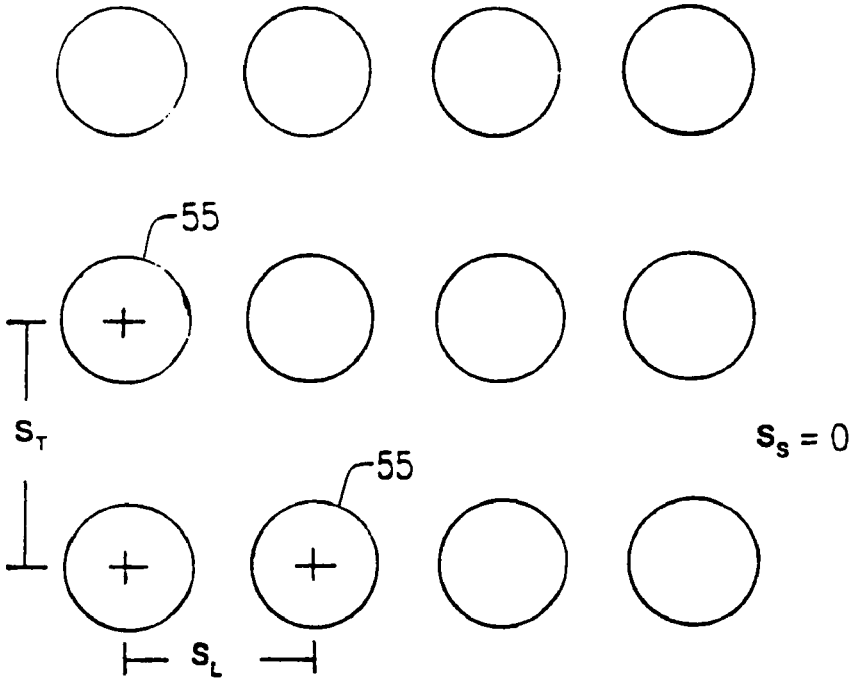
FIG. 5 is a side elevation layout of an in-line embodiment of the condenser of the present invention.

Referring now to FIGS. 3 and 4, in particular, the condenser 50 illustrated therein comprises a plurality of in-line tube banks 52. Each tube bank 52 comprises a serpentine tube formed of a plurality of parallel straight tube segments 54 extending in horizontal rows 55 between a pair of spaced, opposed end plates 58 and return bends 56 connecting neighboring straight tube segments 56 in a conventional manner. Each successive tube bank 52 is aligned with the other tube banks so that respective parallel tube rows 55 are disposed in-line from the front to the rear of the condenser 50. In this arrangement, as best seen in FIGS. 3, 5 and 7, the open free air flow area through the condenser 50 is maximized for a given overall face area extending between the spaced end plates 58, the base plate 44 and the top plate 66 which extends between the end plates 58 over the top of the condenser tube banks 52, while the air flow area that is blocked is minimized. By minimizing the blocked flow area and maximizing the open flow area, the tendency of dust, grease and other debris in the ambient air flow passing through the condenser to deposit onto the tubes is significantly reduced, thereby providing a relatively foul-free condenser design.

Figure 6:
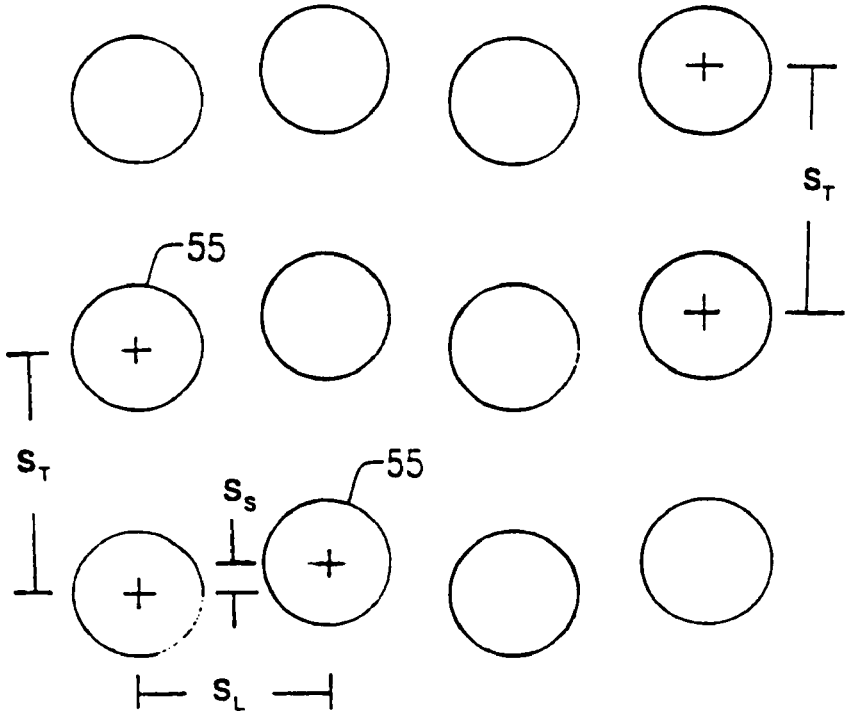
FIG. 6 is side elevation layout of a staggered row embodiment of the condenser of the present invention.

In the slightly staggered tube arrangement of the condenser 50 of the present invention illustrated diagrammatically in FIG. 6, the open free air flow area is somewhat reduced from that provided in the pure in-line tube arrangement depicted diagrammatically in FIG. 5. However, the slightly staggered tube arrangement exhibits somewhat more efficient heat transfer performance than that associated with the pure in-line tube arrangement, but still exhibits excellent resistance to fouling from dirt and dust in the air passing through the condenser 50. In the slightly staggered tube arrangement illustrated in FIG. 6, the tubes are spaced within each tube bank at a transverse spacing of $S_t$ as measured from tube centerline to tube centerline, with the tube banks alternately offset in the transverse direction rather than with the rows of successive tube banks being aligned in-line. That is, the non-finned condenser tubes of the slightly staggered arrangement of the condenser of the present invention are arranged in at least one first tube bank and at least one second bank, with each tube of the second tube bank disposed relative to a respective tube of the first tube bank at a transverse offset, $S_s$, measured tube centerline of the first tube bank to tube centerline of respective tubes of the second tube bank of not greater than 0.25 $S_t$ and advantageously in the range of 0.06 to 0.25 $S_t$.

Although shown and described herein with the tube rows 55 disposed horizontally, it is to be understood that the condenser tube banks 52 could readily be orientated with the tube rows 55 disposed vertically. Further, the condenser 50 may consist of any number of tube banks and any number of tube rows within the tube banks and any length for the tube rows, as desired, as long as the tube rows are aligned in either an in-line arrangement as depicted diagrammatically in FIG. 5 or in a slightly staggered arrangement as depicted diagrammatically in FIG. 6. Additionally, in any embodiment of the present invention, the tube banks of non-finned tubes are arranged with a longitudinal spacing, $S_l$, that is a spacing in the general direction of the fluid flow through the condenser 50, where the ratio of $S_l$ to $S_t$ is at least 0.7.

The condenser fan 60 is disposed adjacent the condenser 50 and advantageously downstream with respect to air flow of the condenser 50 so as to draw the air flow through the condenser tube banks 52. As illustrated in FIG. 7, the condenser fan 60 may be encompassed by a shroud 90 which mates at its forward edge with the end plates 58 and the top plate 66 encompassing the condenser tube banks 52. The fan shroud 90 may incorporate the top plate 66 as a plate extending forwardly from the upper edge of the fan shroud. Together the fan shroud 90, the condenser top plate 66, the condenser end plates 58 and the base plate 44 form in effect a tunnel through which ambient flow is channeled through the open flow area between the tube rows 55 of the condenser 50. It is believed that such channeling of the air flow therethrough results in less turbulence as the air flow passes through the condenser 50 thereby channeling dust, grease and other debris through the open flow area between the tube rows 55 of the condenser 50, as opposed to more likely contacting the tubes as would be the case in a more turbulent flow or in a conventional prior art condenser having staggered tube rows from tube bank to tube bank.

What is claimed is:

1. A refrigerated merchandiser comprising:

an enclosure defining a refrigerated display cabinet;

an evaporator disposed in operative association with the refrigerated display cabinet;

a compartment heat insulated from the refrigerated display cabinet a condenser disposed within said compartment;

a condenser fan disposed within said compartment in operative association with said condenser; and a compressor disposed within said compartment and connected in refrigerant flow communication with said evaporator and said condenser for circulating refrigerant through said evaporator and said condenser;

said condenser having at least one first tube bank and at least one second tube bank, each tube bank being an unfinned serpentine tube having a plurality of a parallel, straight tube rows extending between a pair of spaced end plates, the tube rows within each tube bank being spaced apart at a transverse spacing $S_t$, the first and second tube banks being disposed such that respective tube rows are offset in a staggered arrangement with an offset $S_S$ of not greater than 0.25 $S_t$.

2. A refrigerated merchandiser as recited in claim 1 wherein the first and second tube banks being disposed such that respective tube rows are offset in a staggered arrangement with an offset $S_s$ in the range of 0.06 to 0.25 $S_t$.

3. A refrigerated merchandiser as recited in claim 1 wherein the tube banks are spaced apart in the longitudinal direction at a spacing of at least 0.7 the transverse spacing $S_t$ between tube rows within the tube banks.

* * * * *

UNITED STATES PATENT AND TRADEMARK OFFICE

CERTIFICATE OF CORRECTION

PATENT NO. : 7,028,497 B2
APPLICATION NO. : 10/960387
DATED : April 18, 2006
INVENTOR(S) : Ronald D. Upton et al.

It is certified that error appears in the above-identified patent and that said Letters Patent is hereby corrected as shown below:

Column 4 line 21 change numeral "56" to numeral --54--

Column 4 line 25 change "as best seen in FIGS. 3, 5 and 7" to --as best seen in FIGS. 3, 4 and 7--

Signed and Sealed this

Tenth Day of October, 2006

JON W. DUDAS
*Director of the United States Patent and Trademark Office*